US006878220B2

(12) United States Patent
Gehringhoff et al.

(10) Patent No.: US 6,878,220 B2
(45) Date of Patent: Apr. 12, 2005

(54) METHOD OF MAKING A HARDENED SHEET METAL ARTICLE

(75) Inventors: Ludger Gehringhoff, Paderborn (DE); Udo Klasfauseweh, Gütersloh (DE); Ralf Köhler, Attoln (DE); Ulrich Jungblut, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 207 days.

(21) Appl. No.: 10/262,563

(22) Filed: Sep. 30, 2002

(65) Prior Publication Data

US 2003/0066582 A1 Apr. 10, 2003

(30) Foreign Application Priority Data

Oct. 5, 2001 (DE) ..... 101 49 221

(51) Int. Cl.[7] ..... C21D 8/00

(52) U.S. Cl. ..... 148/654; 148/647; 148/649

(58) Field of Search ..... 148/649, 647, 148/335, 654; 75/335

(56) References Cited

FOREIGN PATENT DOCUMENTS

| | | | |
|---|---|---|---|
| DE | 24 25 486 | 5/1975 | |
| GB | 1490 535 | 11/1977 | |
| JP | 363274719 | * 11/1988 | ..... 148/649 |
| WO | PCT/SE98/01354 | 2/1999 | |

* cited by examiner

*Primary Examiner*—Deborah Yee
(74) *Attorney, Agent, or Firm*—Henry M. Feiereisen

(57) ABSTRACT

In a method of making a hardened sheet metal article, at least one pot-shaped depression is formed in a sheet metal blank. Thereafter, the sheet metal blank is hot formed in a press mold to a sheet metal article, and the sheet metal article is hardened. The press mold provides hereby a calibration of the depression to provide the final shape.

9 Claims, 1 Drawing Sheet

METHOD OF MAKING A HARDENED SHEET METAL ARTICLE

CROSS-REFERENCES TO RELATED APPLICATIONS

This application claims the priority of German Patent Application, Serial No. 101 49 221.9, filed Oct. 5, 2001, pursuant to 35 U.S.C. 119(a)–(d), the disclosure of which is incorporated herein by reference.

BACKGROUND OF THE INVENTION

The present invention relates to a method of making a hardened sheet metal article. In addition, the present invention relates to a press mold for carrying out the method.

To ensure clarity, it is necessary to establish the definition of several important terms and expressions that will be used throughout this disclosure. The term "blank" is used here in a generic sense and refers to a flat sheet steel plate as well as to a pre-formed semi-finished product. The term "heat-treating" or "heat treatment" is also used here in a generic sense and includes, i.a., quenching and tempering. The term "press mold" is also used here in a generic sense and includes a progressive die assembly which is capable to perform two or more operations, e.g. pressing, shaping, hardening etc.

German patent publication DE 24 52 486 A1 describes a method of making a hardened sheet metal article from a blank through a press hardening process by heating a blank of hardenable steel to a hardening temperature, placing the blank in a press mold for hot forming to the desired final shape, and hardening the final sheet metal product in the press mold. Since the final sheet metal product remains clamped in the press mold during the cooling process carried out during the hardening operation, the product is accuracy in size.

Through combination of the shaping and hardening and quenching steps in a single tool, hot forming and hardening in the press mold is an cost-effective process.

International patent publication WO 99/07492 discloses a modification of the afore-described press hardening process by collaring marginal areas of a plurality of holes in the press mold. The holes are collared in the press mold before the hardening process. The openings in the sheet metal product serve as through-bores for screw fasteners. These openings, also called in the art as "through-passages", are utilized as reference holes or seats for accurate alignment of the sheet metal product in subsequent processes. In addition, these openings are also provided as assembly clearance or for reinforcement measure.

The components of this conventional press mold are subjected to great wear, when the openings are shaped. In addition, the collaring operation results only in a limited shaping of the collar. A further drawback is the increased costs compared to the conventional cold forming process.

It would therefore be desirable and advantageous to provide an improved method of making hardened sheet metal articles, which obviates prior art shortcomings and which can be carried out in a more economical and efficient manner.

SUMMARY OF THE INVENTION

According to one aspect of the present invention, a method of making a hardened sheet metal article, includes the steps of forming at least one pot-shaped depression in a sheet metal blank, hot-forming the sheet metal blank in a press mold to a sheet metal article, and hardening the sheet metal article.

The depression may have any desired shape. Examples include round or oval shaped depressions. Since the pot-shaped depression is made prior to the hot forming process, the tool is less subjected to wear during heat treatment. As a consequence of providing pot-shaped depressions in a pre-form tool, the versatility as far as shape is concerned is significantly greater. The pre-form tool also allows a formation of a pot-shaped depression in several stages. Overall, manufacturing costs are reduced.

The depressions in the sheet metal article may be used as reference points in subsequent operations so that the sheet metal article can be precisely positioned. Of course, the depressions may also be used for reinforcement of the sheet metal article.

According to another feature of the present invention, the sheet metal blank may be calibrated in the press mold to produce the final shape. Thus, the depression is shaped in the press mold to a precise size before the hardening process is carried out. The hardening process involves also a cooling action while the sheet metal article is clamped in the press mold.

According to another feature of the present invention, the blank is made of steel which may have the following composition, by weight percent: 0.19 to 0.25% carbon (C), 0.15 to 0.50% silicon (Si), 1.10 to 1.40% manganese (Mn), 0.020 to 0.050% titanium (Ti), 0.002 to 0.005% boron (B), 0.02 to 0.06% aluminum (Al), a maximum of 0.025% phosphorus (P), a maximum of 0.015% sulfur (S), a maximum of 0.35% chromium (Cr), and a maximum of 0.35% molybdenum (Mo), and the balance being iron (Fe) and other incidental impurities as a result of melting.

The sheet metal blank, formed with one or more depressions, is heated in a heat treatment apparatus to a hardening temperature, which is above $Ac_3$ where the steel is in austenitic state. Normally, the steel is heated to a temperature between 775° C. and 1000° C. The subsequent forming process is executed in the press mold, with the cooling operation triggering a hardening of the product to obtain a fine-grain martensitic or bainitic structure. During the hardening process, the sheet metal article is restrained in the press mold. The cooling operation may be carried out directly or indirectly. Direct cooling involves a direct contact of the sheet metal article with a coolant, whereas indirect cooling involves a cooling of the press mold or components thereof.

According to another feature of the present invention, the bottom of a depression can be cut out and removed in the press mold. This may be realized through appropriate configuration of the male mold (or plunger) of the press mold. The bottom can be ripped out during calibration of the drawn depression.

According to another feature of the present invention, the depression may have a ratio of diameter to depth of 2:1. Currently preferred is a configuration of the depression with a diameter of at least 20 mm and a depth of about 10 mm.

According to another feature of the present invention, the sheet metal article may be cut or trimmed in a post-operation. An example of a post-operation involves a trimming of the pot-shaped depression. Also, the sheet metal article itself may be subjected to cutting operations. When depressions are no longer required and are situated in the waste region of the sheet metal article, it is also possible to remove the depressions themselves.

According to another aspect of the present invention, a press mold for making a hardened sheet metal article, includes an upper die accommodating a male mold, a lower die accommodating a female mold which defines a cavity with the male mold when the male mold is moved against the female mold to thereby calibrate a pot-shaped depression of a heated sheet metal blank, restrained between the upper and lower dies, and to provide a sheet metal article, and a cooling system for cooling and thereby hardening the sheet metal article.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
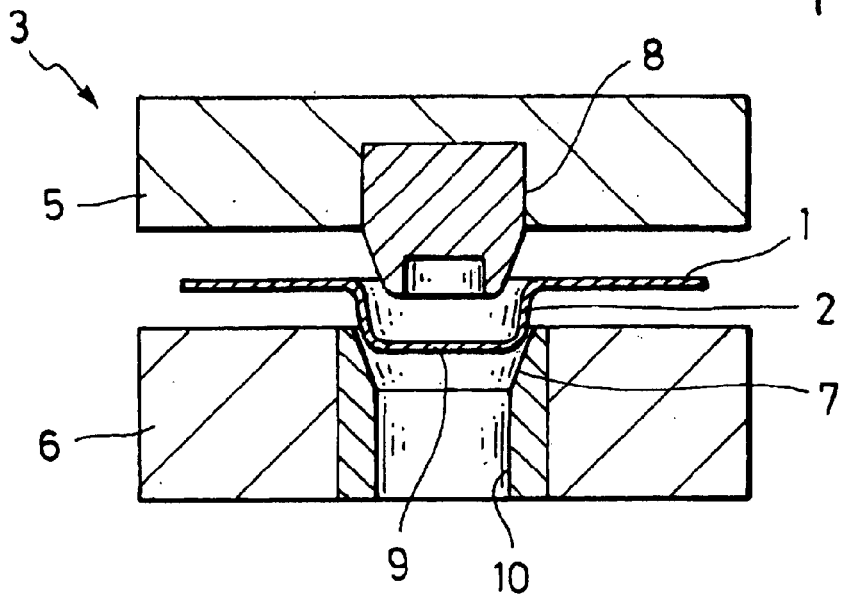
FIG. 1 is a simplified schematic cutaway view of a press mold with inserted sheet metal blank for making a sheet metal article in accordance with the present invention.

Throughout all the Figures, same or corresponding elements are generally indicated by same reference numerals.

Turning now to the drawing, and in particular to FIG. 1, there is shown a simplified schematic cutaway view of a press mold with inserted blank 1 of sheet steel for making a sheet metal article 4 in accordance with the present invention. The blank 1 has already been formed with an unfinished pot-shaped depression 2 before the actual reshaping and heat-treatment processes in the press mold according to the present invention.

The blank 1 is heated to a hardening temperature, which is above $Ac_3$. Depending on the steel used, the hardening temperature is between 775° C. and 1000° C. so that the steel is in an austenitic state. Subsequently, the blank 1 is shaped to size in a press mold 3 to a desired final sheet metal article 4. The press mold 3 has an upper die 5 and a lower die 6. Accommodated in the lower die 6 is the female mold 7, which is suited to the contour of the pot-shaped depression 2, whereas a complementary male mold or plunger 8 is provided in the upper die 5. During pressing operation, the depression 2 is calibrated in the press mold, i.e. is formed to a desired final and precise shape. This process involves only a minor forming of the depression to final shape. While still being clamped in the press mold, the sheet metal article 4 is rapidly cooled down to effect a hardening thereof.

Figure 2:
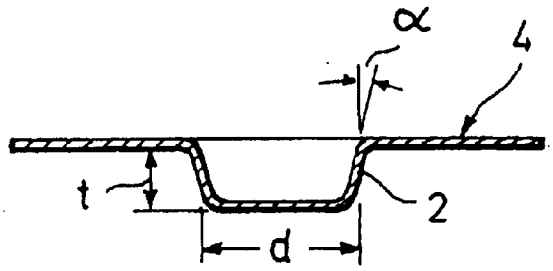
FIG. 2 is a fragmentary side view of a sheet metal article with a pot-shaped depression.
Figure 3:
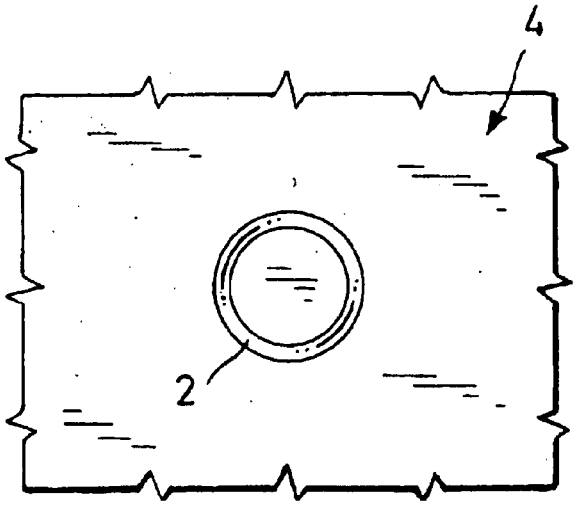
FIG. 3 is a top view of the sheet metal article of FIG. 2.

FIGS. 2 and 3 show side and top views of the sheet metal article 4 with pot-shaped depression 2. In the non-limiting example shown here, the depression 2 has a depth t of 10 mm and a mean diameter d of 20 mm. The female mold 7 has a conical configuration so that the depression 2 is downwardly tapered at an angle $\alpha$ of about 10° or greater. This ensures that the sheet metal article 4 can easily be knocked out of the press mold. In addition, the taper of the depression 2 also ensures a simple and accurate positioning of the sheet metal article 4 in post-operations. The depression 2 may serve as reference as well as reinforcement of the final sheet metal article 4.

Through suitable configuration of the male mold 8, the bottom 9 of the drawn depression 2 can be cut away or ripped out during calibration to thereby provide a through-passage. The removed bottom 9 may be discharged via a scrap removal channel 10 in the lower die 6.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A method of making a hardened sheet metal article, comprising the steps of:

forming at least one pot-shaped depression in a sheet metal blank;

hot-forming the sheet metal blank in a press mold to a sheet metal article; and hardening the sheet metal article.

2. The method of claim 1, and further comprising the step of pre-forming the sheet metal blank before the forming step.

3. The method of claim 1, and further comprising the step of calibrating the depression into a final shape.

4. The method of claim 1, and further comprising the step of removing a bottom of the depression.

5. The method of claim 1, wherein the depression has a ratio of diameter to depth of 2:1.

6. The method of claim 5, wherein the depression has a diameter of at least 20 mm and a depth of about 10 mm.

7. The method of claim 1, and further comprising the step of cutting the sheet metal article in a post-operation.

8. The method of claim 1, wherein the blank is made of steel having a following composition, by weight percent 0.19 to 0.25% carbon (C), 0.15 to 0.50% silicon (Si), 1.10 to 1.40% manganese (Mn), 0.020 to 0.050% titanium (TI), 0.002 to 0.005% boron (B), 0.02 to 0.06% aluminum (Al), a maximum of 0.025% phosphorus (P), a maximum of 0.015% sulfur (S), a maximum of 0.35% chromium (Cr), and a maximum of 0.35% molybdenum (Mo), and the balance being iron (Fe) and other incidental impurities.

9. The method of claim 1, wherein the depression has a taper in downward direction at an angle of about at least 10°.

* * * * *